United States Patent [19]

Magdovitz

[11] Patent Number: 4,750,281

[45] Date of Patent: Jun. 14, 1988

[54] SERVICE SELECTOR

[76] Inventor: Allen A. Magdovitz, 555 Filmore St., Pasadena, Calif. 91106

[21] Appl. No.: 925,542

[22] Filed: Oct. 31, 1986

[51] Int. Cl.[4] ..... G09F 1/10

[52] U.S. Cl. ..... 40/124.2; 40/19.5

[58] Field of Search ..... 40/124.2, 124.4, 19.5; 211/50, 55, 56

[56] References Cited

U.S. PATENT DOCUMENTS

| | | | |
|---|---|---|---|
| 342,316 | 5/1886 | Bickford | 40/124.2 |
| 2,437,415 | 3/1948 | Berry | 40/124.2 |
| 3,535,806 | 10/1970 | Tucker | 40/124.2 |
| 3,995,387 | 12/1976 | Lotts | 40/19.5 |
| 4,003,470 | 1/1977 | Lagorio et al. | 40/124.2 |
| 4,041,631 | 8/1977 | Stevens | 40/124.2 |

FOREIGN PATENT DOCUMENTS

| | | | |
|---|---|---|---|
| 460364 | 10/1949 | Canada | 40/124.4 |

*Primary Examiner*—Robert P. Swiatek
*Assistant Examiner*—J. Hakomaiu
*Attorney, Agent, or Firm*—William W. Haefliger

[57] ABSTRACT

A method of displaying and dispensing service of information includes:

(a) providing a support to extend generally upright, (b) providing groups of cards with each card having first and second separable sections, (c) providing legible generic service information on the first section of each card, and specific service information on the second section of each card, the legible information on the cards in the same group being the same, and the legible information on the cards in different groups being different, (d) supporting the groups of cards at different locations on the support with the cards in each group extending generally upright and in a front to rear stack, and blocking viewing of the second sections of the cards in each stack while maintaining the first sections of the cards in each stack successively visible as the cards are removed sequentially from the stack, (e) sequentially removing selected cards from different stacks in accordance with selected generic information visible on such cards, (f) optionally separating the first and second sections of each removed card in order to retain the second section of the card on which is provided the specific information, (g) and periodically refilling like information cards into corresponding said stacks to replace removed cards.

5 Claims, 2 Drawing Sheets

SERVICE SELECTOR

BACKGROUND OF THE INVENTION

This invention relates generally to information display and retrieval, and more particularly to method and apparatus to quickly retrieve specific information when its general category is known, and to easily file same.

Service information is displayed in telephone directories, as in the so-called yellow pages; however, such directories are often bulky and otherwise difficult to use; and the specific information displayed is not physically retrievable for filing without cutting the pages; also only one listing of specific service information is available in each large directory, and cannot be easily transported. Business cards represent a source of specific information; however, they are not readily available when needed, and certainly a large number of like cards, or of different cards representing specific available services in different categories, are not available. Also, such cards are not displayed for ready scanning, retrieval and filing, but are rather kept in business card files. There is need for method and apparatus to overcome these difficulties.

SUMMARY OF THE INVENTION

It is a major object of the invention to provide a method and structural combinations adapted to provide a unique solution to these problems.

Basically, the method of the present invention for displaying and dispensing legible service information or data, as at a service center, grocery store, or other place where consumers pass by, includes:

(a) providing a support to extend generally upright, (b) providing groups of cards with each card having first and second separable sections, (c) providing legible generic service information on the first section of each card, and specific service information on the second section of each card, the legible information on the cards in the same group being the same, and the legible information on the cards in different groups being different, (d) supporting the groups of cards at different locations on the support with the cards in each group extending generally upright and in a front to rear stack, and blocking viewing of the second section of the card in each stack while maintaining the first sections of the cards in each stack successively visible as the cards are removed sequentially from the stack, (e) sequentially removing selected cards from different stacks in accordance with selected generic information visible on such cards, (f) optionally separating the first and second sections of each removed card in order to retain the second section of the card on which is provided the specific information, (g) and periodically refilling like information cards into corresponding said stacks to replace removed cards.

The cards typically have their second sections of business card size so that they may readily be filed by the user with other such cards possessed by the user; and the cards may advantageously be perforated along a tear line separating the general and specific information sections, whereby the first (generic) information section may be torn off after use of such section for card selection.

Also contemplated is the provision of a holder that extends horizontally and forms multiple recesses which are alike and horizontally spaced apart, said d) step including supporting a group of the cards in each recess so that the card first sections extend above the recess; the provision of multiple holders each forming said multiple recesses, and locating the multiple holders spaced apart in an upright direction; and the provision of recesses in the holders so sized as to enable card group support, card selection, and dispensing, as will be seen.

These and other objects and advantages of the invention, as well as the details of an illustrative embodiment will be more fully understood from the following specification and drawings, in which:

DETAILED DESCRIPTION

DETAILED DESCRIPTION

Figure 1:
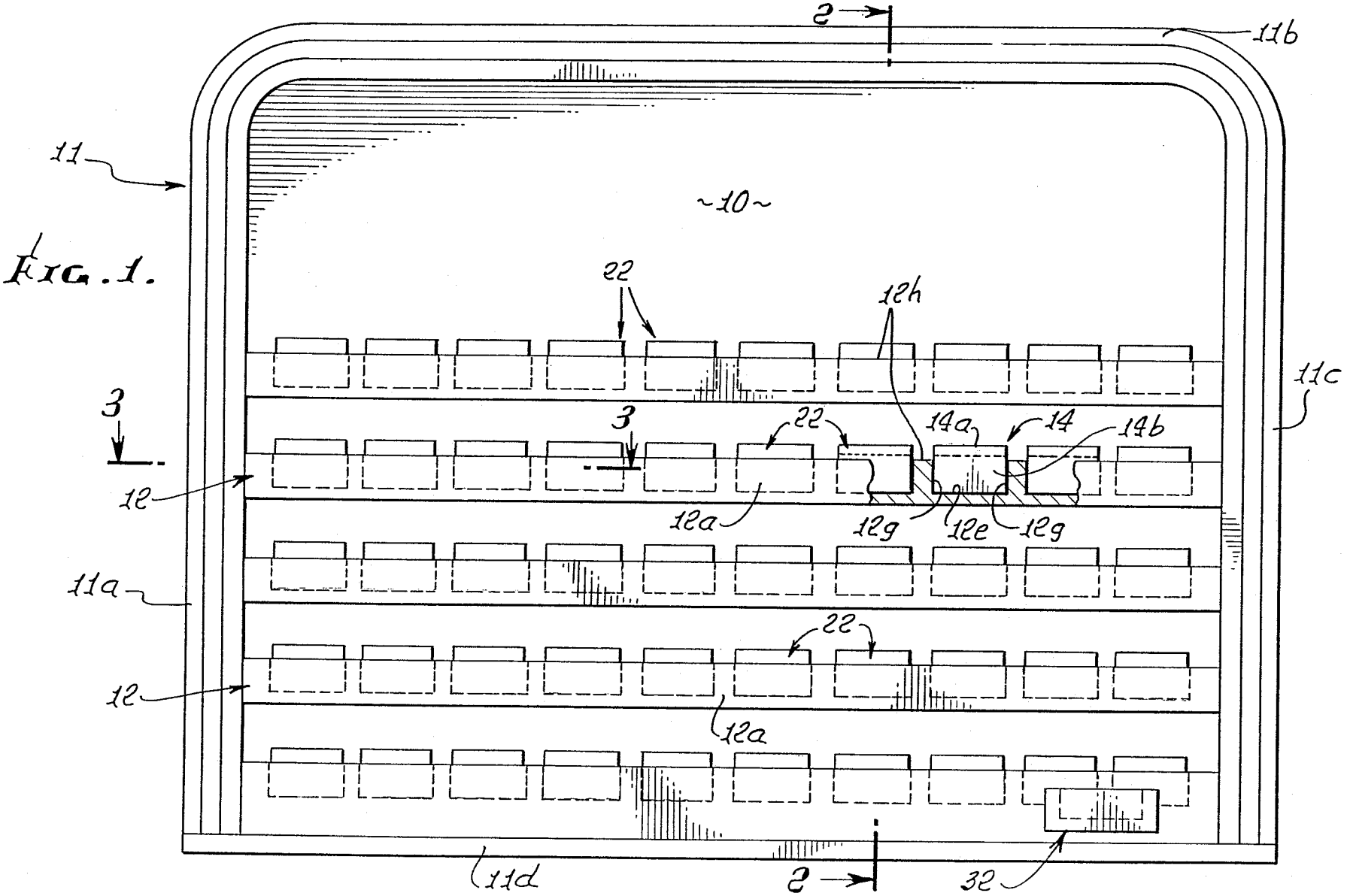
FIG. 1 is an elevational view showing support apparatus useful in using and carrying out the invention.
Figure 2:
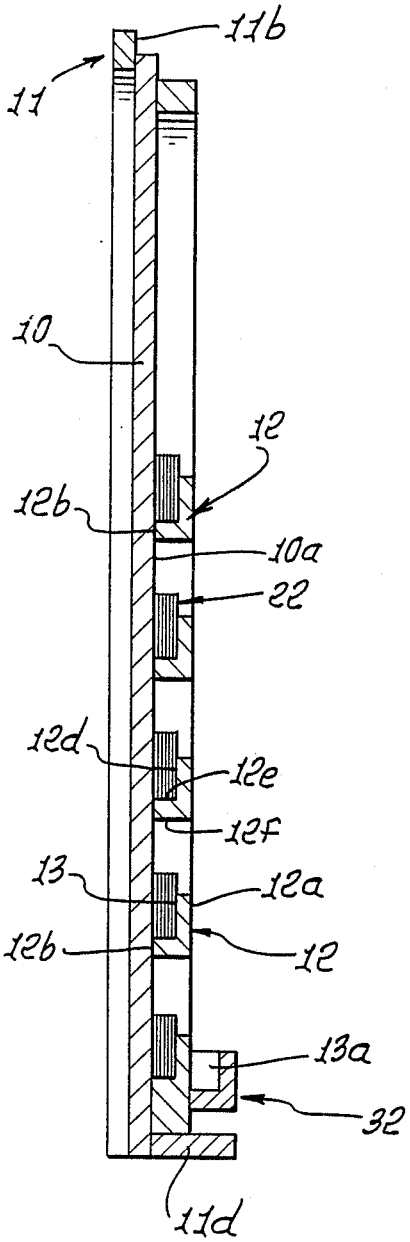
FIG. 2 is an enlarged section, in elevation, taken on lines 2—2 of FIG. 1.
Figure 3:
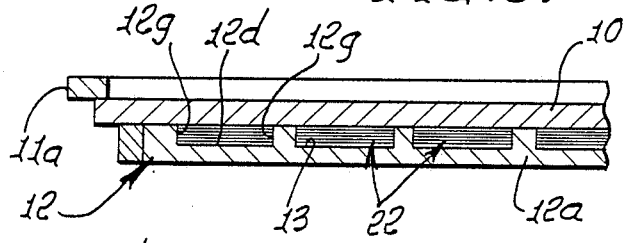
FIG. 3 is an enlarged fragmentary plan view on lines 3—3 of FIG. 1.

In FIGS. 1–3, a support plate or board 10 extends generally vertically. A frame 11 bounds the plate on three sides at 11*a*–11*c;* and a bottom frame piece 11*d* extends is attached to the bottom of the plate.

In accordance with the invention, a holder 12, or typically multiple holders 12, are provided to extend horizontally and to form or provide multiple recesses or pockets 13 which are alike. Each holder may take the form of a horizontal member having front and rear sides 12*a* and 12*b;* and the recesses are sunk into the rear side 12*b* of the member as shown, to have upright inner sides 12*d*, and bottom walls 12*e*, spaced above the bottom 12*f* of each member. Opposite inner end walls of the recesses appear at 12*g*. Multiple such holders 12 are provided to be vertically spaced at the planar front side 10*a* of the plate 10, and the rear sides 12*b* of the holders may be rigidly attached to the side 10*a*, by suitable means, so that the holder members 12 extend directly above one another, but separated as shown. Each holder member includes multiple recesses 13, and the recesses 13 in the vertically spaced holders may be arranged in vertical columns. All such recesses are alike.

Figure 4:
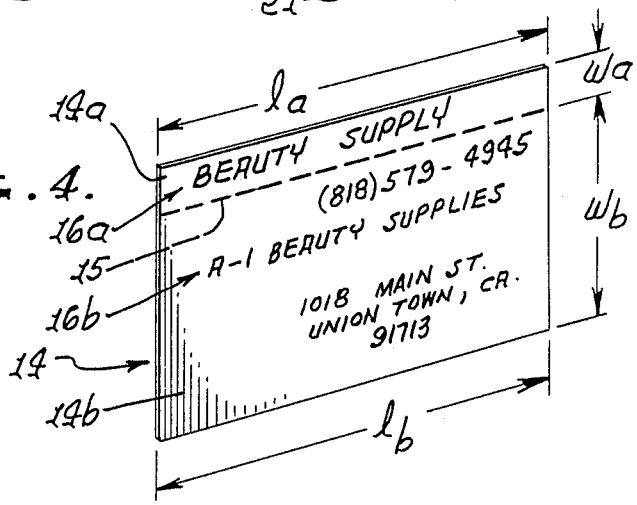
FIG. 4 is a perspective view of a two section card embodying both generic and specific service information, usable in card groups, in conjunction with the FIG. 1 support apparatus, in carrying out the method of the invention.

In accordance with an important aspect of the invention, groups of cards are provided, the cards of each group being alike to have first and second separable sections. See for example card 14 in FIG. 4, which is rectangular; it has upper and lower sections 14*a* and 14*b*, which are or may be easily separable; and the card dimensions are typically as follows:

Upper or first section 14*a:* width ($w_a$)=$\frac{1}{4}$ to 1 inch length($l_a$)≅$3\frac{1}{2}$ inches

Lower or second section 14b:

width ($w_b$)≅$1\frac{7}{8}$ inches length ($l_b$)≅$3\frac{1}{2}$ inches

In one example, $w_a$ is about $\frac{3}{8}$ inch.

Accordingly, the lower section 14b has the size of a standard business card, and it typically contains data or information which is legible and is specific, i.e. identifies a particular business establishment. (A-1 Beauty Supplies, for example, plus an address and telephone number). The upper section 14a of the card, on the other hand, contains legible data or information which is not specific, but rather is generic, i.e. identifies a category of business into which the specific information on section 14b fits. (Beauty Supplies, in the example). The upper section 14a is typically joined to the lower section 14b so as to be easily removable therefrom, as by tearing along a perforation line indicated at 15, that line extending horizontally in the example.

Figure 5:
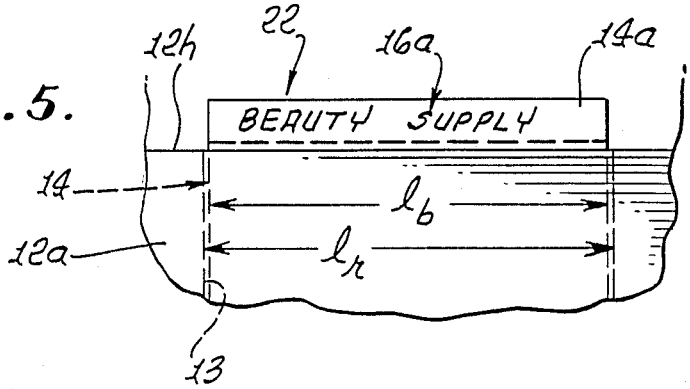
FIG. 5 is an enlarged view of a card supported to display generic data only.

It is a feature of the invention that a group 22 of like such cards is received in each recess 13 to extend generally upright and in a front-to-rear stack, to be withdrawn one by one, in front to rear sequence. Further, and as seen in FIG. 5, the support (as by surface 12e) of the cards in the group is such that the first sections 14a of the cards in each group project above the top level 12h of the recess, and of the holder itself, whereas the second section of each such card remains concealed in the recess (to a viewer from the front of the board 10) until such time as that card is selected and withdrawn from the recess. In addition, the cards of different groups, carry different generic information 16a, and different specific information 16b, but as referred to above, the cards in one particular group carry the same generic information 16a and the same specific information 16b. Thus, to a viewer looking at the display, he only sees the various generic data on different front card sections 14a, which enables him to quickly scan the display for that particular generic information or field in which he is interested. He only gains knowledge of specific information on section 14b by lifting the front card of that group. After he has so selected a card and lifted it from the recess, he no longer requires the generic data, so that he then separates section 14a from section 14b, retaining the latter and disposing of the former. Since section 14b is now typically reduced to business card size, he may now store it with other business cards he has in his possession, for use as in contacting the establishment identified at 16b on the second section 14b. Also, new cards 14 may be re-filled into recesses 13 from which corresponding cards have been withdrawn. These functions are aided by so arranging the holders 12 that each group of cards associated with a holder or holders other than the uppermost holder are located in direct upright alignment with and everywhere spaced below the next above holder, the holders having upright outermost surfaces that define a common upright plane, all cards spaced sidewardly of that plane, as seen in the drawings.

The complete method of the invention may now be set forth as follows:

(a) providing a support to extend generally upright, (b) providing groups of cards with each card having first and second separable sections, (c) providing legible generic service information on the first section of each card, and specific service information on the second section of each card, the legible information on the cards in the same group being the same, and the legible information on the cards in different groups being different, (d) supporting the groups of cards at different locations on the support with the cards in each group extending generally upright and in a front to rear stack, and blocking viewing of the second section of the card in each stack while maintaining the first section of the cards in each stack successively visible as the cards are removed sequentially from the stack, (e) sequentially removing selected cards from different stacks in accordance with selected generic information visible on such cards, (f) optionally separating the first and second sections of each removed card in order to retain the second section of the card on which is provided the specific information, (g) and periodically refilling like information cards into corresponding said stacks to replace removed cards.

Note that each recess 13 has a length $l_r$ slightly larger than the length of "$l_b$" of the card section 14b; and the height of the recess is approximately equal to the width $w_b$ of the lower section 14b of the card. Typically, between 10 and 75 cards fill the recess.

Figure 6:
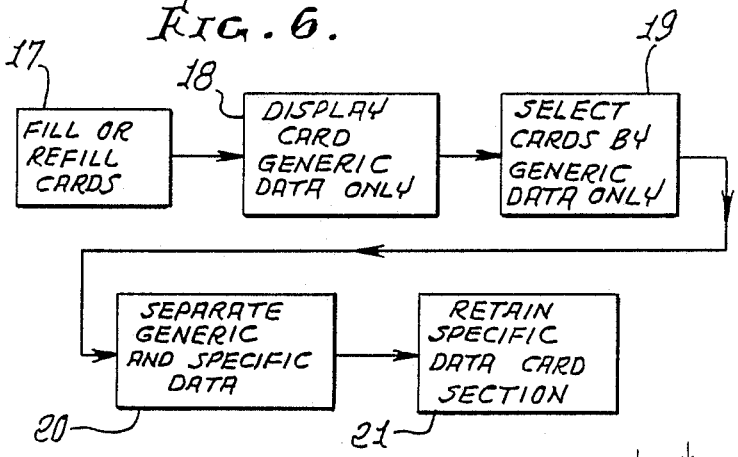
FIG. 6 is a flow diagram illustrating steps in the method of card use, in accordance with the invention.

FIG. 6 shows steps of the method in block form: cards are filled or refilled into the recesses at 17; only generic data is displayed to the viewer, at 18; cards are selected according to displayed generic data, at 19; the two sections (14a and 14b) of a selected card are separated at 20; and separated sections containing specific data or information are filed at 21. Thus, a very speedy method, and unusually advantageous apparatus, are provided to enable a service seeker to rapidly locate, access and file (retain) specific services provided, as available.

Removed sections 14a may be dropped into a receptacle or recess 13a in a lower holder 32 on the plate 10.

I claim:

1. In the method of displaying and dispensing service information, the steps that include:

(a) providing a support to extend generally upright, (b) providing groups of cards with each card having first and second separable sections, and providing said section or sections to have business card size, (c) providing legible generic service information on the first section of each card, and specific service information on the second section of each card, the legible information on the cards in different groups being different, (d) providing multiple holders on the support so that each holder extends horizontally and forms multiple recesses which are alike and horizontally spaced apart, and supporting the groups of cards at different locations on the support so that each group of cards is supported in a respective recess and so that each card first section is positoned to extend above the recess, and so that only the second section of each card is concealed within the recess, and with the cards in each group extending generally upright and in a front to rear stack, and blocking viewing of the second sections of the cards in each stack while maintaining the first sections of the cars in each stack successively visible as the cards are removed sequentially from the stack, (e) sequentially removing selected cards from different stacks in accordance with selected generic information visible on such cards, (f) optionally separating the first and second sections of each removed card in order to retain the second section of the card on which is provided the specific information, (g) and periodically refilling like information cards into corresponding said stacks to replace removed cards, (h) said (b) step including perforating each card horizontally along a single line between said sections which then are upper and lower sections, thereby to provide each card first section with the following dimensions:

width$=\frac{1}{4}$ to 1 inch length$\cong 3\frac{1}{2}$ inches and each card second section with the following dimensions:

width$\cong 1\frac{7}{8}$ inches length$\cong 3\frac{1}{2}$ inches, whereby the sections may be easily separated after withdrawal of the card from its support location, and so that the second section alone has business card size.

2. The method of claim 1 including providing multiple of said horizontally extending holders each forming said multiple recesses, and locating said multiple holders spaced apart in an upright direction.

3. The method of claim 2 wherein said holders comprises horizontally elongated members and said (a) step includes providing a support plate, and including attaching said holders to said plate.

4. In apparatus for displaying and dispensing service information, the combination that includes:

(a) support extending generally upright, (b) like groups of cards with each card having first and second separable sections, the second sections being of business card size, (c) legible generic service information on the first section of each card, and specific service information on the second section of each card, the legible information on the cards in the same group being the same, and the legible information on the cards in different groups being different, (d) the groups of cards supported at different locations on the support, with the cards in each group extending generally upright and in a front to rear stack, and means blocking viewing of the second sections of the cards in each stack while maintaining the first sections of the cards in each stack successively visible as the cards are removed sequentially from the stack, (e) selected cards being sequentially removable from different stacks in accordance with selected generic information visible on such cards, (f) the first and second sections of each removed card being optionally separable along a separation line on the card in order to retain the second section of the card on which is provided the specific information, (g) and like information cards being periodically refillable into corresponding said stacks to replace removed cards, (h) each card being preforated along a single horizontal line between said sections which then are upper and lower sections, whereby the sections may be separated after withdrawal of the card from its support location, (i) the support including a holder that extends horizontally and forms multiple recesses which are alike and horizontally spaced apart, each recess having a horizontal length slightly longer than the card length, and a vertical height substantially equal to the height of the card second section, a group of the cards supported in each recess so that the card first section extends above the recess, and said line is in approximate registration with an upper edge defined by the recess, and including a plate to which the holder is attached, (j) the support including multiple of said horizontally extending holders, each holder forming multiple recesses, said multiple holders spaced apart in an upright direction and carried by the plate, each group of cards associated with a holder or holders other than the uppermost holder being located in direct upright alignment with and everywhere spaced below the next above holder, the holders having upright outermost surfaces that define a common upright plane, all cards spaced rearwardly of that plane, (k) each card first section ahving the following dimensions:

width$=\frac{1}{4}$ to 1 inch length$\cong 3\frac{1}{2}$ inches (l) each card second section having the following dimensions:

width$\cong 1\frac{7}{8}$ inches length$\cong 3\frac{1}{2}$ inches.

5. The combination of claim 4 wherein said holders comprise horizontally elongated members having front and rear sides, the recesses sunk in the rear sides of said members.

* * * * *